United States Patent [19]

Edgawa et al.

[11] 4,219,996

[45] Sep. 2, 1980

[54] MULTI-COMPONENT SPUN YARN

[75] Inventors: Hiroshi Edgawa; Toshinori Fujita, both of Ohtsu; Yasuo Uesugi, Shiga, all of Japan

[73] Assignee: Toray Industries, Inc., Tokyo, Japan

[21] Appl. No.: 934,806

[22] Filed: Aug. 18, 1978

[30] Foreign Application Priority Data

| | | | |
|---|---|---|---|
| Aug. 23, 1977 | [JP] | Japan | 52-100969 |
| Aug. 23, 1977 | [JP] | Japan | 52-100970 |
| Aug. 23, 1977 | [JP] | Japan | 52-100973 |

[51] Int. Cl.[2] ..... D02G 3/04; D02G 3/26; D02G 3/34

[52] U.S. Cl. ..... 57/225; 57/243

[58] Field of Search ..... 57/200, 210, 225, 227, 57/228, 231, 243, 248, 252, 3, 6, 13, 58.89, 328

[56] References Cited

U.S. PATENT DOCUMENTS

| | | | |
|---|---|---|---|
| 2,552,210 | 5/1951 | Parker | 57/328 |
| 3,605,395 | 9/1971 | Morikawa et al. | 57/58.89 |
| 3,722,202 | 3/1973 | Indarte | 57/210 |
| 3,831,369 | 8/1974 | Northup et al. | 57/210 X |
| 4,018,042 | 4/1977 | Maag et al. | 57/210 |
| 4,028,874 | 6/1977 | Maag et al. | 57/210 |

*Primary Examiner*—Donald Watkins
*Attorney, Agent, or Firm*—Miller & Prestia

[57] ABSTRACT

Multi-component spun yarn. The surface of an open-end spun yarn (staple fibers) having a small degree of twist is covered with a continuous yarn twisted in the same direction. The length of the continuous yarn is greater than that of the open-end spun yarn. Manufacturing method and apparatus are also disclosed.

13 Claims, 24 Drawing Figures

FIG. 3A.
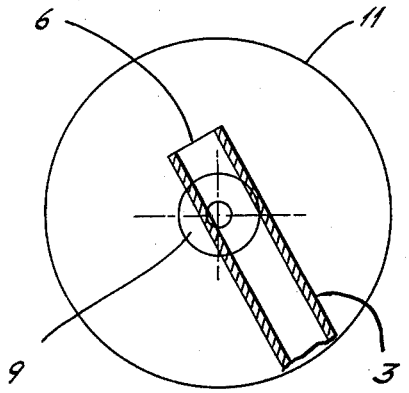
FIG. 3B.
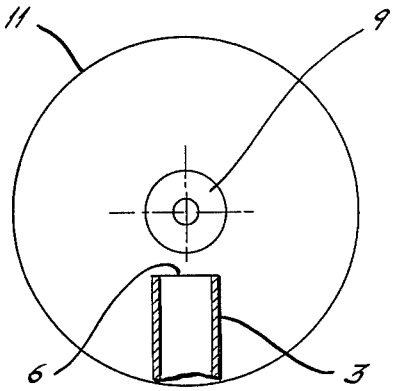
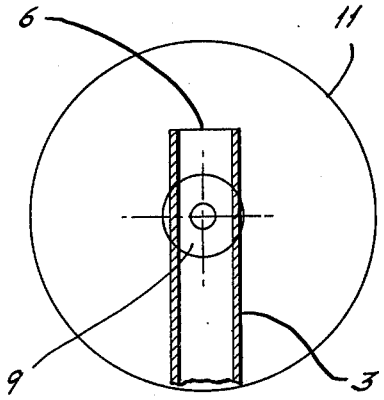
FIG. 3C.
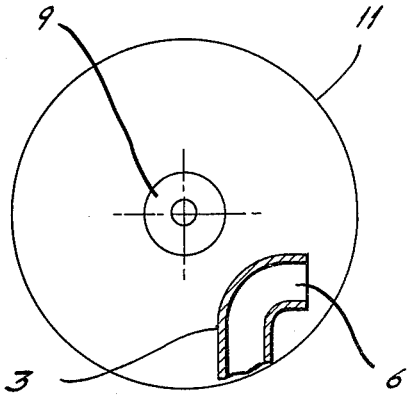
FIG. 3D.

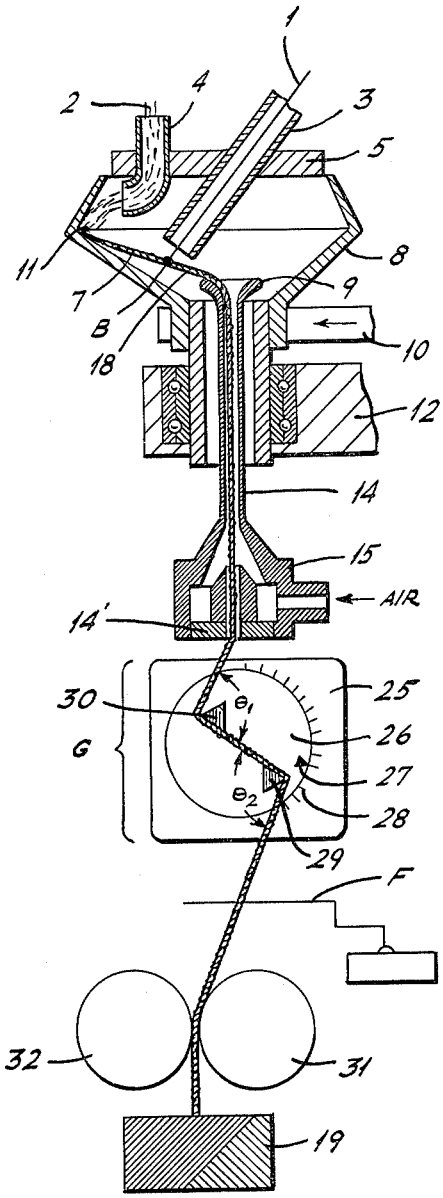
FIG. 10.
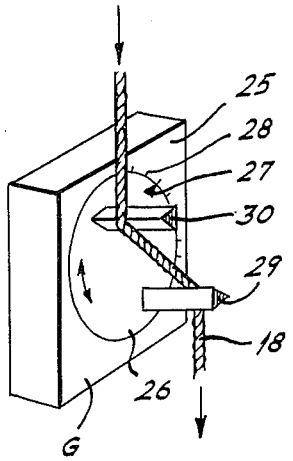
FIG. 11.
FIG. 12.
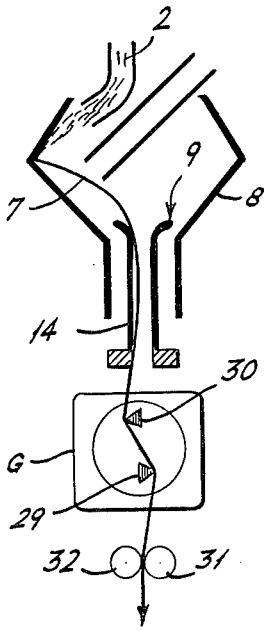
FIG. 13.
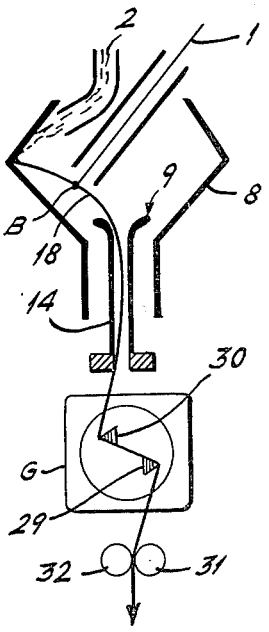

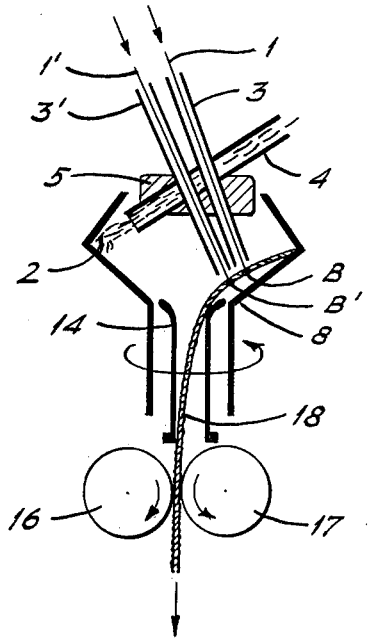
FIG. 14.
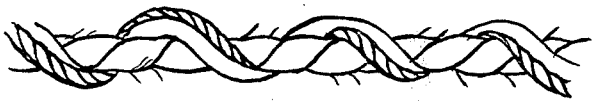
FIG. 15A.
FIG. 15B.
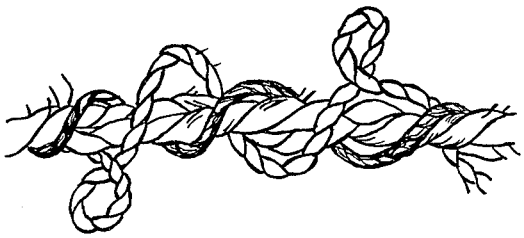

MULTI-COMPONENT SPUN YARN

BACKGROUND OF THE INVENTION

The present invention relates to a multi-component spun yarn consisting of an open-end spun yarn combined with a continuous yarn, and to the method and apparatus for manufacturing same.

Prior Art

Multi-component yarns of two or more different yarns are known. In these yarns each individual yarn is introduced for the purpose of compensating for faulty properties of another. In such a manner, an effort is made to produce a multi-component yarn possessing all the desirable properties of the individual yarns combined into one. Several types of small multi-component yarns have hitherto been known.

For instance, it is known to manufacture a multi-component covered yarn by feeding staple fibers and a continuous yarn into a spinning machine utilizing air and centrifugal force, with a rotary spinning chamber (open-end spinning). Methods of this type have been proposed in Japanese Patent Application Publication Nos. 10260/1972 and 2380/1974, and further in No. 175741975 (corresponding to British Pat. No. 1,154,554).

However, though these methods utilize the open-end spinning process, the multi-component covered yarn product has a continuous yarn as the core yarn, and has an outer spun yarn of staple fibers which is wound around the continuous core yarn.

When using techniques described in the aforementioned publications, it is difficult to avoid yarn breakage in the rotary spinning chamber. Indeed, one encounters more than the frequency of yarn breakage of ordinary spun yarn (100% staple fibers). Not only is yarn breakage very apt to occur, but operational efficiency is poor and it is impossible to achieve proper diversification of spinning materials. Thus, there is much room for improvement.

Similar comments apply as well as to the disclosure of U.S. Pat. No. 3,605,395 and British Pat. Nos. 1,220,390 and 1,495,713.

SUMMARY OF THE INVENTION

It is an object of the present invention to obtain a radically different multi-component spun yarn which overcomes the aforementioned problems.

According to this invention a spun yarn core is provided, consisting of staple fibers, and this core is wrapped with a continuous yarn twisted in the same direction as the twist of the core yarn. A method and apparatus for manufacturing such yarn is described in detail hereinafter.

The structure of the multi-component spun yarn according to the present invention is quite opposite to that of the multi-component spun yarns described in the prior art. The multi-component spun yarn according to the present invention has such a construction that a spun yarn is located approximately at the center and a continuous yarn is wrapped around the spun yarn. The length of the continuous yarn is greater than that of the spun yarn.

We have found that, with the present invention, it is possible to obtain excellent results by the use of a filament yarn as a continuous filament yarn, and by the adoption of a structure wherein the continuous yarn is wrapped around the surface of a spun yarn. The resulting multi-component spun yarn surprisingly possesses the desirable properties of both spun yarn and continuous filament yarn. It has the good touch or hand of which the former is possessed, and also has the excellent resistance to pilling and abrasion possessed by the latter. This makes the yarn most suitable as a material for use in outer garments.

It is another object of the present invention to provide a method for manufacturing such a multi-component spun yarn, and to provide apparatus therefor.

In the multi-component spun yarn according to the present invention, the twist factor "K" of the spun yarn at the core is at a low level of the order of $K \leqq 3.0$. When the number of twists in the spun yarn is expressed as $t_1$, the continuous yarn covers the surface of the spun yarn and is wrapped around it in the same direction as the twist direction of the spun yarn, and with the same number of twists i.e., $t_1$.

Accordingly, the length of the continuous yarn is greater than that of the spun yarn.

One of the characteristics of the multi-component spun yarn according to the present invention lies in the fact that the twist factor K of the spun yarn is, as stated above, as small as $K \leqq 3.0$. Preferably, this value should be $1.8 \leqq K \leqq 3.0$.

The twist factor K is expressed by the formula $K = t_1/\sqrt{N}$, wherein:

$t_1$ = number of twists of the spun yarn (turns/in.),

N = English cotton yarn count of the spun yarn.

In open-end spinning with a feed of 100% staple fibers to the open-end spinning system, it is ordinarily difficult to spin the stable fibers at a twist factor below 3.5. Such a low twist gives rise to frequent yarn breakage and neps from rubbing. The term "rubbing" as used herein refers to friction to which the spinning yarn is subjected when it passes through the guides provided in the open-end spinning system, mainly on the center piece inside the rotary spinning chamber, at the outlet of the yarn delivery tube, etc. Because of the low degree of twist the quality of the resulting yarn is very poor. For this reason, in manufacturing spun yarns consisting of staple fibers only by the open-end spinning system, a twist factor of about 4.0 is usually used.

It is ordinarily impossible to produce acceptable yarns if the twist factor is below 3.0. Such a low twist level causes frequency neps from rubbing, frequent yarn breakage, etc.

In the present invention, staple fibers and continuous yarn are fed together into the rotary spinning chamber. The resulting multi-component yarn has such a structure that the continuous yarn wraps around the spun yarn in the rotary spinning chamber. Even though the twist factor of the spun yarn component may be as small as less than 3.0, the continuous yarn which is wrapped around the spun yarn contributes to the maintenance of strength and continuity and imparts to the yarn considerable resistance to the effects of rubbing. This makes it feasible to spin at a very low twist factor and thus produces a yarn of superior quality.

It is an outstanding characteristic of the multi-component spun yarn of this invention that it is possible to provide a very low level twist factor of the spun yarn at the core.

Although the continuous yarn is wrapped around the surface of the spun yarn, it does not completely cover the entire surface of the spun yarn but wraps around it in the manner of a spiral. Hence the spun yarn itself is also exposed on the surface of the multi-component spun yarn. Such a structure gives the multi-component spun yarn of this invention a novel touch—bulkiness and softness—which is sharply different from either an ordinary open-end spun yarn composed of 100% staple fiber or a yarn consisting of 100% continuous filaments.

In comparison with an ordinary open-end spun yarn consisting of 100% staple fibers, with a twist factor of about 4.0, the spun yarn at the core of the multi-component spun yarn of this invention has a much smaller twist factor—less than about 3.0—and this contributes a pleasant soft touch to the multi-component spun yarn. There is another advantage in the fact that the twist factor can be set at a lower level; it is also possible to attain greater productivity.

The multi-component spun yarn of this invention can be manufactured effectively solely by the method according to the present invention, which will be described in further detail hereinafter in this specification.

In the event that two kinds of yarns—a 100% staple fiber spun yarn obtained by the open-end spinning system and a continuous yarn manufactured conventionally—were fed together into a conventional covering yarn manufacturing process, and the continuous yarn were caused to cover the surface of the spun yarn to obtain a multi-component spun yarn, the resulting yarn would be a multi-component spun yarn. However, it would be entirely different from the multi-component spun yarn according to the present invention. Although the two would be superficially similar in respect of structure, the spun yarn at the core of the multi-component spun yarn obtained by the conventional method would have a twist factor value (K) of at least 3.5 and in most cases 4.0 or above.

The multi-component spun yarn of the present invention is obtained by a method in which staple fibers and a continuous filament yarn are fed together under special conditions into the rotary spinning chamber of an open-end spinning system.

The method of the present invention is characterized in that staple fibers are fed into a spinning system provided with a rotary spinning chamber which utilizes air and centrifugal force; then they are concurrently fed under critically controlled tension into the rotary spinning chamber.

Critical tension control of the staple and continuous components surprisingly produces a multi-component spun yarn in which the continuous yarn filaments are wrapped around the spun yarn formed from the staple fibers. If the spinning tension used when staple fibers only are spun into a 100% spun yarn is designated as $T_s$ (grams) and if the feed tension of the continuous filament yarn in the process of this invention is designated as $T_f$ (grams), the relationship between $T_s$ and $T_f$ according to this invention is:

$$0.1 \leqq T_f/T_s < 0.9.$$

It is necessary in order to achieve stabilized operation, when feeding the continuous yarn into the rotary spinning chamber, to locate the point where the continuous yarn and the spun yarn join with each other in a particular manner. Feeding of the continuous yarn in a special manner is accomplished by the apparatus of the present invention, as will be described in detail hereinafter.

The apparatus for manufacturing the multi-component spun yarn according to the present invention includes an open-end spinning system comprising a rotary spinning chamber, a staple fibers feed tube, a yarn delivery tube which is provided in the rotating spinning chamber, and a special tube for feeding the continuous filament yarn which is to be integrated with the spun yarn. The yarn delivery tube and the continuous filament yarn feed tube are so disposed that their central axes are eccentrically situated, and that their openings do not face each other.

BRIEF DESCRIPTION OF THE DRAWINGS

FIGS. 3A, 3B, 3C and 3D are plan views exemplifying various locational relationships between the spun yarn delivery tube and the continuous filament yarn feed tube in accordance with the present invention.

FIG. 10 is a vertical sectional view of an appartus for manufacturing multi-component spun yarn of the present invention, wherein a twist stopping means is additionally provided, downstream of the center piece.

FIG. 11 is an enlarged perspective view of the twist stopping means employed in the apparatus of FIG. 10.

FIGS. 12 and 13 are schematic vertical sectional views which illustrate a method of spinning a multi-component spun yarn by the use of the apparatus shown in FIGS. 10 and 11.

FIG. 14 is a sectional view of an apparatus in which, as a modification, two continuous yarns are used.

FIGS. 15A and 15B show the external appearances of yarn obtained by the method illustrated in FIG. 14.

DETAILED DESCRIPTION OF PREFERRED EMBODIMENTS

Figure 1:
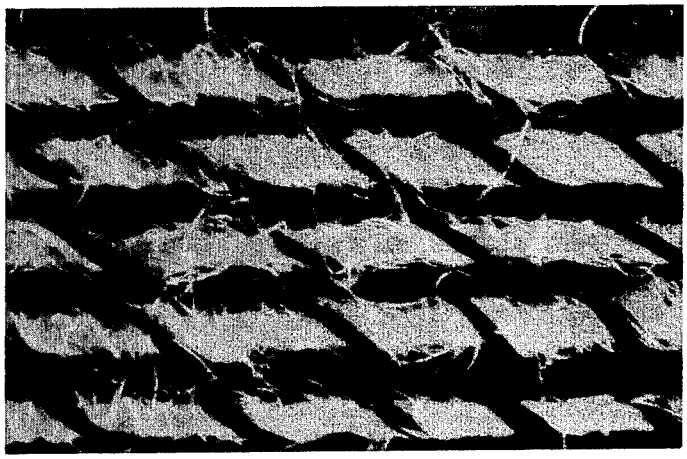
FIG. 1 is an enlarged photographic side view of multi-component spun yarns according to the present invention. For the purpose of clarity, the continuous filament yarn was dyed black. The white portion seen at the core is a spun yarn formed of staple fibers.

The multi-component spun yarn according to the present invention has, as is shown clearly in FIG. 1, such a structure that the surface of a spun yarn having a twist factor (K) of under 3.0 is partially covered with a continuous yarn which is wrapped around it in the same direction. The number of covering turns is $t_1$ when the number of twists of the spun yarn (per unit of length) is $t_1$. The lower limit of the twist factor K is preferably 1.8. In a multi-component spun yarn such as this, the length of the continuous filament yarn is greater than that of the spun yarn. In this particular instance of the multi-component spun yarn according to the present invention, the length of the continuous yarn gives an index of about 100.5 to 115, inclusive, with the length of the multi-component spun yarn taken at 100. This means that the ratio of difference of yarn length "Q", which will be explained later, is in the range of about 0.5 to 15 percent.

Furthermore, when the weight ratio of the continuous yarn, on the basis of the weight of the entire multi-component spun yarn, is preferably about 5 to 60 percent, or most preferably about 5 to 40 percent, the multi-component spun yarn is most suitable as a material for outer garments.

As components of the continuous yarn of the present invention, various types of continuous filament yarns and of spun yarns, as well as their combinations, may be used. When, above all, continuous filament yarn is used as the continuous yarn, it is possible, by properly modifying the weight ratios of the spun yarn and the continuous filament yarn, to obtain a product having properties either nearer to that of a spun yarn or nearer to that of a filament yarn as desired. Hence, a continuous filament yarn is preferable.

The method of manufacturing a multi-component spun yarn according to the present invention will be described with reference to FIG. 2.

In said Figure, staple fibers 2 are fed through a staple fibers feeding tube 4 into a rotary spinning chamber 8. They are fed in the direction of the inner wall of chamber 8. A continuous yarn 1 is, on the other hand, fed through a continuous yarn feed tube 3 which projects into the rotary spinning chamber 8 at a location spaced apart from the open end of tube 4.

The staple fibers 2, passing through the maximum diameter portion 11 of the rotary spinning chamber 8, form a spun yarn 7, which makes its way toward a yarn delivery tube 14. Such spun yarn 7 and the continuous yarn 1 are united at a uniting point "B", thereby forming a multi-component spun yarn of the present invention.

Figure 5:
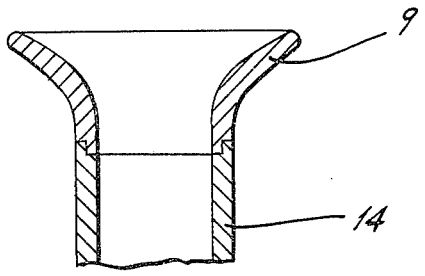
FIG. 5 is an enlarged sectional view of the end portion of a yarn delivery tube which is a component of the open-end spinning apparatus.

The rotary spinning chamber 8 is pivotally supported by a bearing 12 and is driven by a belt 10. The yarn delivery tube 14 is supported by a spindle holder 13. Further, the open end 9 of said yarn delivery tube 14 which extends into the rotary spinning chamber 8 acts as a means for imparting frictional false twist to the multi-component spun yarn 18. The open end 9 of the yarn delivery tube 14 is commonly referred to as the "center piece". A sectional view of the center piece 9 and of its associated tube 14 appears in FIG. 5. The surface of the center piece which comes into contact with the yarn is either made of a material having a high coefficient of friction or is very rugged. The multi-component spun yarn 18, after passing through the yarn delivery tube 14, is drawn out by delivery rollers 16 and 17, and is taken up on a package 19. The feeding tubes 3 and 4 are secured in position by a fastening means such as a plate 5. The numeral 15 indicates a compressed air nozzle which jets out air for introduction of a piecing yarn into the rotary spinning chamber, useable for starting up.

Figure 4:
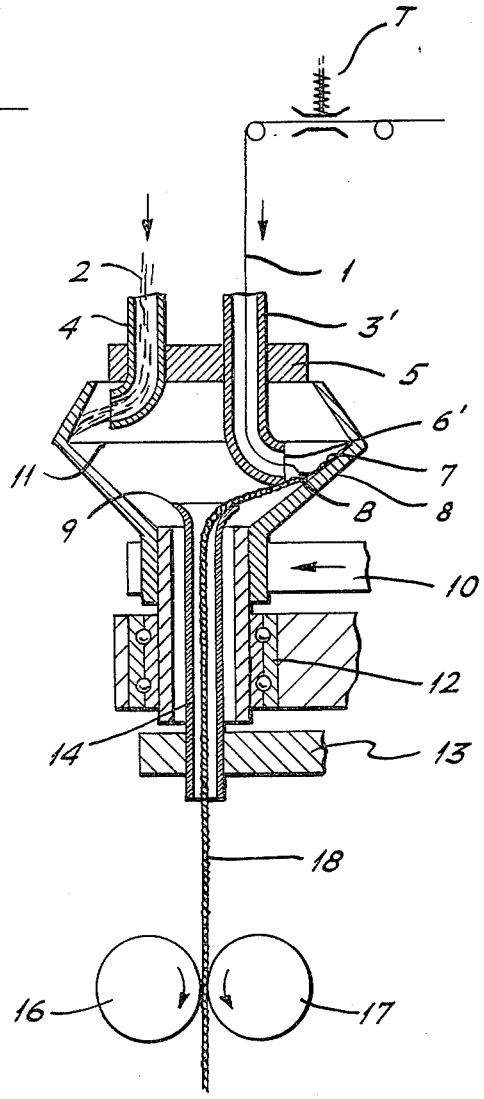
FIG. 4 illustrates, in vertical section similar to FIG. 2, another embodiment of the method of manufacturing multi-component spun yarn according to the present invention.

FIG. 4 shows the continuous yarn feeding tube 3' in another mode of embodiment of the invention. While in other respects the apparatus of FIG. 4 is similar to that of FIG. 3, the tube 3' is downwardly outwardly curved at its delivery end, which faces oppositely to the open end of staple feed tube 4.

A system for starting spinning of multi-component spun yarn of the present invention will be explained with reference to FIGS. 7A, 7B and 7C of the drawings.

Figure 7A:
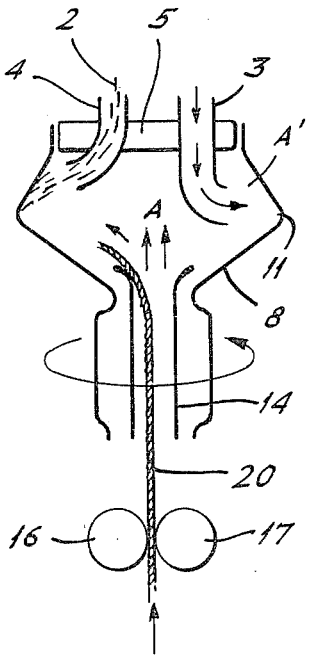
FIGS. 7A, 7B and 7C are schematic vertical sectional views which illustrate a system for starting spinning of a multi-component spun yarn of the present invention.
Figure 7B:
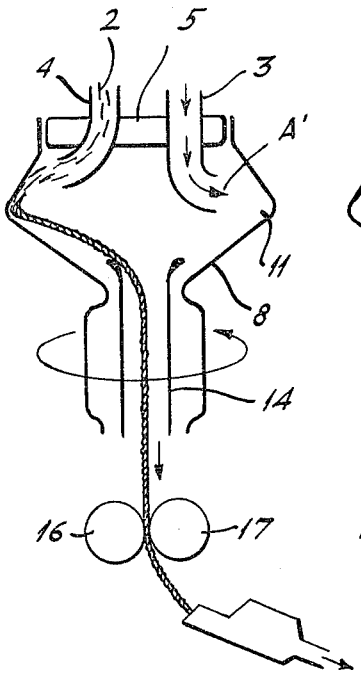
Figure 7C:
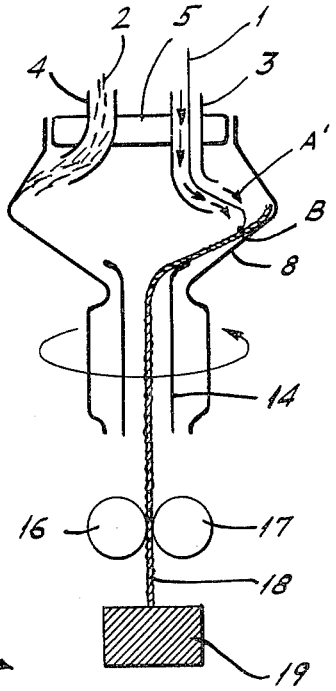

At the outset a piecing yarn 20 is introduced into the hollow of the yarn delivery tube 14, from its lower end as shown in FIG. 7A, by air stream "A" jetted out from the compressed air supplying nozzle 15, leading it into the rotary spinning chamber 8. Piecing yarn 20 is caused to move forward to the maximum diameter portion 11 of rotary spinning chamber 8 by centrifugal force. Staple fibers 2, which have previously been thoroughly opened, are fed through the staple fibers feeding tube 4 into the rotary spinning chamber 8 in the direction of movement of its inner wall, and are heaped up in the maximum diameter portion 11 of the rotary spinning chamber. These heaped-up staple fibers and the aforesaid piecing yarn 20 cling together and are thus integrated, and form a spun yarn 7 as shown in FIG. 7B. The starter yarn 20, with the starting portion of the spun yarn, is taken off to the side, as shown in FIG. 7B. After having started spinning the spun yarn 7 in this way, the continuous yarn 1 is fed, through the continuous yarn feeding tube 3, into the rotary spinning chamber 8 by the action of suction air A', and is caused to unite with the spun yarn at the uniting point B, thereby to spin the multi-component spun yarn 18, as shown in FIG. 7C.

It is important in the manufacturing of the multi-component spun yarn of the present invention that the relative tensions of the continuous yarn feed and of the spun yarn product are critically controlled. When the spinning tension applied to staple fibers (spun into a spun yarn which is complete by itself) is designated as $T_s$ (grams) and when the feed tension of the continuous yarn is designated as $T_f$(grams), spinning is carried out in a manner to satisfy the following relationship between $T_s$ and $T_f$, viz:

$$0.1 \leqq T_f/T_s < 0.9$$

If an attempt is made to spin outside the foregoing limitation, it becomes extremely difficult to manufacture a multi-component spun yarn with satisfactory results.

Figure 2:
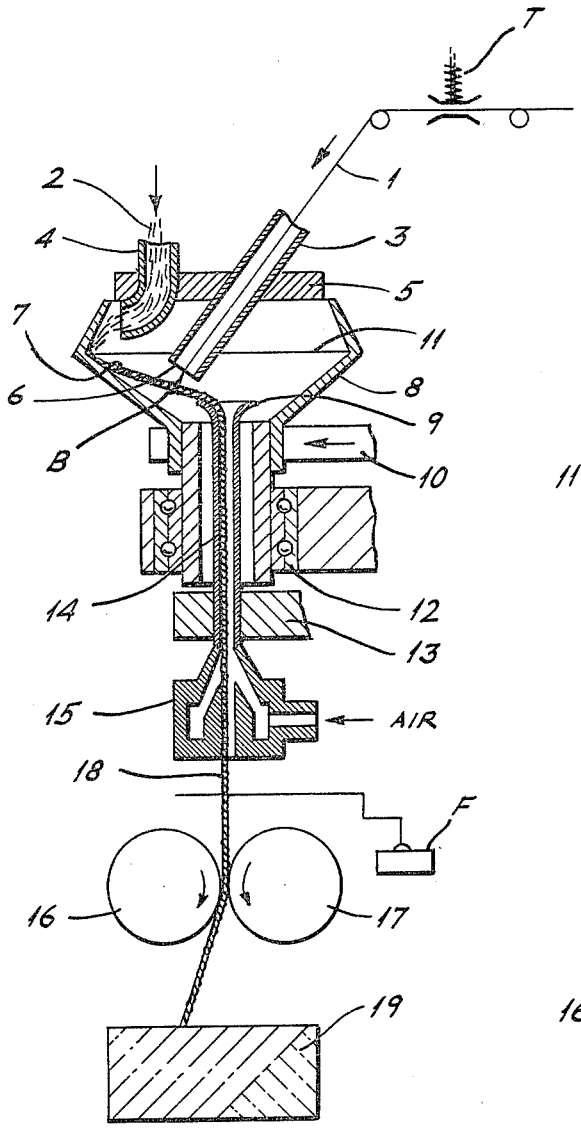
FIG. 2 is a vertical sectional view of a composite yarn spinning machine embodying features of this invention, with most parts shown in section, and further illustrates a method of manufacturing multi-component spun yarn according to the present invention.

The feed tension $T_f$ of the continuous yarn is a value which can be set as desired by the use of a tension regulating device "T" as shown in FIG. 2 or in FIG. 4.

Reference has heretofore been made to the expression "spinning tension $T_s$ applied to staple fibers spun into a spun yarn which is complete by itself", or the like. This expression relates to the spinning tension of a spun yarn in the case where solely a spun yarn is made. This tension $T_s$ exists, for example, in the equipment shown in FIG. 4 provided there are not provided, between the center piece 9 and the delivery rollers, any parts or guides or the like which substantially offer an obstacle to the movement of the yarn. In other words, with conditions as shown in FIG. 7B, the tension $T_s$ is measured between the center piece 9 and the delivery rollers 16, 17. Such tension can be measured with a commonly-known tension gauge. If a false twister is provided between the center piece 9 and the delivery rollers 16, 17 in the open-end spinning system, or if a twist stopping device is provided as in FIG. 8 or in FIG. 10 the tension $T_s$ is measured with the false twister or the twist stopping device removed.

Figure 6:
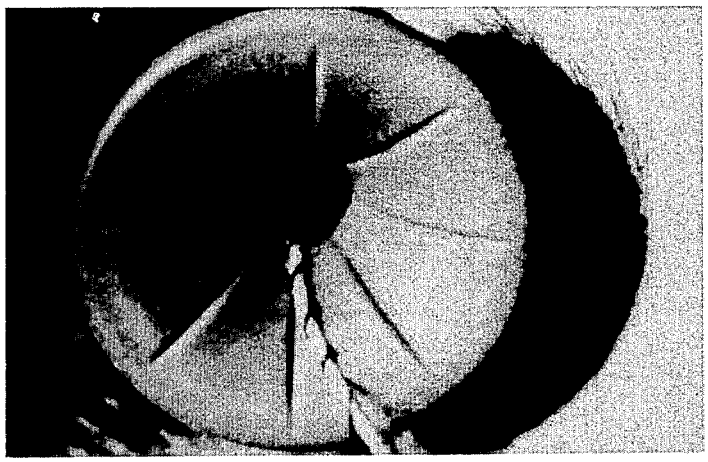
FIG. 6 is a stroboscopic photograph of the end of a yarn delivery tube inside a rotary spinning chamber, taken while manufacturing a multi-component spun yarn of the present invention. This Figure illustrates the position at which a continuous yarn may be integrated with a spun yarn in the practice of the present invention.

It is important to locate carefully the point where the continuous yarn and the spun yarn are united—the uniting point "B". It is so devised as to be located at least on the periphery of the center piece 9 or further outward. This special relationship in respect of the location of the uniting point B, unique to the present invention, is distinctly shown in FIG. 6. In the present invention, such uniting point B is really an arc, since it shifts its position continuously, revolving around the central axis of the yarn delivery tube 14, while the multi-component yarn is being manufactured.

In this way, a multi-component spun yarn reinforced with a continuous wrapped yarn around a spun yarn passes over the center piece 9, and in virtue of this, it becomes possible, as was stated in the foregoing, to spin out a spun yarn at a twist factor as low as less than 3.0.

In the method of the present invention, furthermore, it is desirable that production be carried out so as to satisfy the relationship:

$$T_s' - T_f \geqq 10 \text{ (grams)};$$

and still further, it is preferable, for a stabilized operation of the manufacture of multi-component spun yarns, to set the range of $T_f$ so as to satisfy the relationship:

$$2 \text{ (grams)} \leqq T_f \leqq 25 \text{ (grams)}.$$

The following is a detailed explanation of such relationship between $T_s'$ (grams) and $T_f$ (grams).

Figure 8:
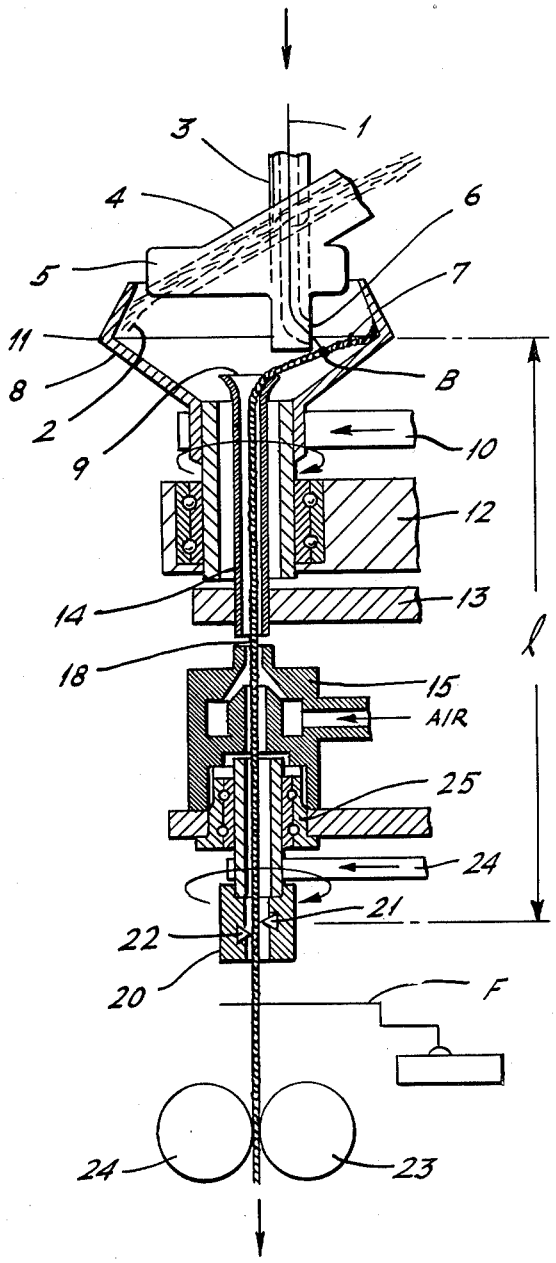
FIG. 8 is a vertical sectional view of an apparatus for manufacturing a multi-component spun yarn of the present invention wherein a false twister is additionally provided underneath the yarn delivery tube.

$T_s'$ is a value which is different from the aforesaid $T_s$. It is the value of the tension which, when spinning out only a spun yarn consisting of staple fibers, is measured at the position of the feeler "F", as shown in FIGS. 2, 8 and 10, which is a means for detecting yarn breakage ordinarily provided in open-end spinning systems.

The term "$T_s'$" is, of course, a value different from $F_s$. It is the value of the tension measured when spinning out solely a spun yarn consisting of staple fibers. It is measured at the position of the feeler "F", as shown in FIGS. 2, 8 and 10, and provides a novel means for detecting yarn breakage using a feeler ordinarily provided in open-end spinning systems. When a false twister or a twist stopping means is provided downstream of the yarn delivery tube, it is necessary to measure said $T_s'$ under the conditions where such means are provided.

It is a very important condition that the production of multi-component spun yarns according to the present invention be carried out so as to satisfy the abovementioned relationship between values $T_s'$ and $T_f$, viz.:

$$T_s' - T_f \leqq 0.10 \text{ (grams)}.$$

Such relationship is an important requisite for taking appropriate measures against yarn breakage. In the method of the present invention the rotary spinning chamber rotates at high speed. Two kinds of yarns, one a continuous yarn and the other a spun yarn, are integrated while the latter is spun, thereby to manufacture a multi-component spun yarn. If breakage of either the spun yarn or the continuous yarn, or of the multi-component spun yarn itself occurs, serious trouble results. Yarn breakage occurs mostly with the continuous yarn, or with the spun yarn which is formed while passing through the maximum diameter portion of the rotary spinning chamber where it is twisted. There is more probability of the latter occurring.

When either one of these events occurs only one of the yarns is drawn out by the delivery rollers; in either case, the feeding of the (broken) continuous yarn or staple fibers must be stopped at once.

If measures are not taken for stopping the feeding of staple fibers in these cases of yarn breakage, this will not only make it impossible to obtain a normal multi-component spun yarn but will cause an abnormally large heap of material fibers to build up in the rotary spinning chamber, eventually damaging a part or parts of the equipment. If, on the other hand, feeding of the continuous yarn is not interrupted, only said continuous yarn will be wound on the winder, and its removal all mean great loss of time and labor. It is for the purpose of unfailingly detecting such cases of yarn breakage that it is required to satisfy the aforesaid relationship between $T_s'$ and $T_f$.

As stated above, it is required to set the value of $T_s' - T_f$ at 10 grams at the least. When the value is less than about 10 grams, it becomes difficult to detect breakage of only one of the two components of the yarn, since its effect is very delicate. To enlarge further upon this point, the spinning tension of multi-component spun yarns, in the method of the present invention, is generally low. There is not much difference in spinning tension between the case where only the spun yarn is spun out and the case where only the continuous yarn is fed, the tension being low in both cases. Also, even in the case where these two yarn components are integrated to spin them out as a multi-component spun yarn, there is not much change in the tension, the spinning tension remaining still at a low level. As a consequence, even in the case where the spun yarn has broken and the tension working on the feeler F has become only that of the continuous yarn, the change in the tension applied to the feeler is only slight, and there are accordingly occasions when the feeler fails to detect yarn breakage.

We have, as the result of our studies of this problem, found that, by setting the aforesaid $T_s'$ at a value larger than that of $T_f$ by at least 10 grams, it is possible to detect breakage of the spun yarn unfailingly with the feeler. That is to say, it becomes possible, by setting up a larger difference between the tensions of the two yarn components, to give rise to a greater change in the tension working on the feeler when one of the yarns has broken. This allows us to detect yarn breakage without fail, as a result of such change of tension. When only the continuous yarn has broken, too, there likewise occurs a change from the tension applied in normal operating conditions. This, again, allows yarn breakage to be readily detected.

Whenever any such yarn breakage is detected, feeding of staple fibers and of continuous yarn into the rotary spinning chamber is forthwith interrupted by using means which are commonly known, for instance, by cutting the continuous yarn with a cutter, by drawing out staple fibers with a suction device, or the like.

When no special means is provided, between the center piece and the delivery rollers, as in the apparatus of FIG. 4, it is sometimes difficult to establish the desired relationship between $T_s'$ and $T_f$. In such a case, it is recommended that guide rollers or the like, be provided immediately before the feeler and arranged to establish a zigzag yarn course. This serves to increase in a positive manner the tension of the yarn between the guide rollers and the delivery rollers. It is possible by such means to increase the value of $T_s'$ at a greater level without significantly increasing the value of $T_f$. If a false twister or a twist stopping means, etc. are provided, such means may, of course, be utilized as the means for positively increasing the value of $T_s'$. It is recommended that, in practice, the value of $T_s'$ be set by making proper adjustments when providing such means.

In manufacturing multi-component spun yarn according to the present invention, it is preferable, in the embodiments of the invention shown in FIGS. 2 and 4, to provide a false twister downstream of the yarn delivery tube 14. FIG. 8 is a sectional view of such an apparatus.

By additionally providing false twisting means downstream of the yarn delivery tube as shown in FIG. 2 or in FIG. 4, yarn breakage can be prevented. Further, it becomes possible to produce multi-component spun yarns of the present invention in a very stabilized condition. Such false twist means is, of course, intended to provide false twist other than the frictional false twist which is imparted by the center piece 9 of the yarn delivery tube 14.

Figure 9:
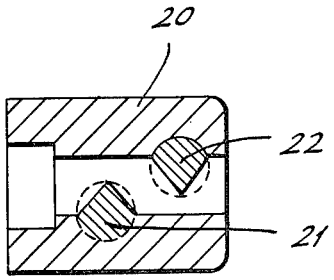
FIG. 9 is a vertical sectional view of the apparatus of FIG. 8.

Referring to FIGS. 8 and 9, staple fibers 2 are fed through the staple fiber supply tube 4 into rotary spinning chamber 8, and are heaped up in its maximum diameter portion 11. From the lower end of the yarn delivery tube 14 a piecing yarn is carried by air stream "A" jetted out from the compressed air supplying nozzle 15, led into the rotary spinning chamber 8, and the aforesaid heaped-up staple fibers and said piecing yarn are integrated into the spun yarn 7, which is drawn out downwardly. The continuous yarn 1 is fed through the continuous yarn feed tube 3 and unites with the spun yarn 7 at uniting point "B", thereby forming the multi-component spun yarn 18. In these respects, the procedure is the same as in the previously-mentioned embodiments. In this embodiments, however, false twister 20 is provided in the downstream of the yarn delivery tube 14. One object of this is to manufacture multi-component spun yarns in a satisfactory manner, without yarn breakage problems.

While the twist factor of the spun yarn can be set at a low level, it is a general rule in an open-end spinning system that the smaller the twist factor becomes, the greater is the probability of yarn breakage. The lower the density of twists applied to the spun yarn in the rotary spinning chamber, especially, in its maximum diameter portion the more likely the yarn is to break.

Therefore, it is preferable to apply twist to the yarn in a positive manner between the maximum diameter portion 11 of the rotary spinning chamber 8 and the delivery rollers 23 and 24. In this manner a high twist thus applied reaches all the way back to the portion of the yarn that is located in the maximum diameter portion of the chamber 8. It is, of course, not necessary to insert true twist; the result is achived by inserting false twist. By inserting false twist into the yarn in a positive manner with the combined use of the false twister 20, a temporary increase takes place in the number of twists applied to the multi-component spun yarn along the interval "1" which extends between the false twister 20 and the maximum diameter portion 11. This is a temporary increase in the twist factor, making formation of the spun yarn smoother and promoting integration of the spun yarn and the continuous yarn, thus making possible a major reduction of the probability of yarn breakage.

By virtue of such a technique, the manufacture of the multi-component spun yarn of the present invention, in which the twist factor of the spun yarn is at a very low level, can be carried out smoothly. Yarn breakage is avoided both in the starting process where only the spun yarn is first made, and in the principal process when the multi-component spun yarn is produced.

The details of the false twister are shown in FIGS. 8 and 9. A means 20, with a plurality of frictional means 21 and 22, is rotatably supported by a bearing 25, and is driven by power transmitted by a belt 24. It is preferable that said frictional means 21 and 22 are so disposed that the acute angular edge is in contact with the yarn being spun, thereby imparting frictional resistance to the yarn as the means 20 is positively rotated. The direction of rotation in this instance is selected to make the twist factor larger. An enlarged sectional view of means 20 is shown in FIG. 9.

The degree of false twist which is additionally imparted to the multi-component spun yarn with false twister 20 is preferably carefully controlled. When the number of twists applied to the spun yarn solely formed of staple fibers in the rotary spinning chamber is defined as $T_1$, with the twist factor K; and when the number of twists applied to the multi-component spun yarn by the false twister is defined as $t_2$, with the twist factor $K_2$, it is preferred that:

$$3.5 \leqq K + K_2 \leqq 6.0.$$

Here, the unit of number of twists, $t_1$ and $t_2$, is expressed as turns/inch, and when English cotton yarn count of the spun yarn formed of only staple fibers is defined as N, these relationships apply:

$$K = t_1/\sqrt{N}$$

$$K_2 = t_2/\sqrt{N}$$

Accordingly, the main object of providing a false twister, in the present invention, is to eliminate yarn breakage difficulties which may result when the twist factor of the spun yarn is controlled at a very small value. Therefore, when manufacturing a multi-component spun yarn of any desired description, the twist factor, with application of false twist, may be determined in an adequate manner with main consideration given to the spun yarn consisting solely of staple fibers.

The object of making the twist density temporarily higher may also be attained by providing a twist stopping means, for instance, the twist stopper guide "G" additionally provided downstream of the center piece 9, as shown in FIG. 10. The twist stopper guide g contacts the yarn after the passage through the center piece 9 in the rotary spinning chamber, thereby preventing forward twist migration along the spinning yarn. Thus, the twist density between such twist stopper guide and the maximum diameter portion 11 of the rotary chamber is positively increased, thereby preventing yarn breakage.

Such twist stopper guide G consists, as is shown in FIG. 11, of two bar-like guides 29 and 30, which are substantially parallel, fixed at a proper spacing on a circular base 26. The circular base 26 is rotatably mounted on a holder 25 at its center. It is desirable from the viewpoint of operational convenience that the circular base be rotatable through, for instance, an angle of 180 degrees. The base 26 is so designed that it can be set at any angle within such range of angles and can be fastened.

As is shown in FIG. 10, the path of the multi-component spun yarn 18 is bent, through the medium of the lower end 14' of the yarn delivery tube and the bar-like guide 30, to form an angle $\theta_1$ (FIG. 10) with the other bar-like guide 29, and is subsequently bent, through the medium of the bar-like guides 30 and 29, so as to form an angle $\theta_2$ (FIG. 10) with the nip point of take-over rollers 31 and 32, thereby stopping twist migration. The twist stopping effect can be adjusted by adjusting the angle at which the circular base 26 is set.

A schematic view of the external appearance of twist stopper guide G is shown in FIG. 11. Regarding the shape of the bar-like guides 29 and 30, it is preferable from the viewpoint of twist stopping effectiveness to provide them in the form of polygonal prisms having sharp angles where they contact the spinning yarn. Trigonal to octagonal prisms are most preferably employed. It is also desirable that $\theta_3$ (the sum of bending angles $\theta_1$ and $\theta_2$) may be varied within the range of about $10° \leqq \theta_3 \leqq 340°$. Such setting may be easily attained, for instance, by placing a pointer 27 on the circular base 26 and etching a scale 28 on the holder 15. In such a way, the control of each spindle can be carried out individually in an exact manner.

It is desirable that the twist stopper guide is so designed as to be rotatable. If the bending angle of the yarn path is increased to increase the twist stopping effect, it is difficult to insert the piecing yarn when spinning the spun yarn only; it is subjected to an extremely great frictional resistance which makes it subject to damage. After having started spinning the yarn as a multi-component spun yarn, on the other hand, it is possible to increase the twist stopping effect without fear of damaging the yarn since the spun yarn component is reinforced by the continuous yarn component. Accordingly, by increasing the twist stopping effect, chances of yarn breakage are reduced and the integration of the spun yarn and continuous yarn is promoted, making it possible to manufacture the multi-component spun yarn of the present invention in a very stabilized operational condition.

This embodiment of the invention is shown in FIGS. 12 and 13. As shown in FIG. 12, the equipment is adjusted with a smaller twist stopping effect when the spun yarn is spun out alone as a starting step of the process, while it is set at a sharper angle in FIG. 13 to increase the twist stopping effect when the yarn is spun out as a multi-component spun yarn.

However, it goes without saying that said twist stopper guide may be one which is of the fixed type, if desired in any particular installation.

Further, it is also possible to use the false twister, which is positioned downstream of the yarn delivery tube 14, both as the twist stopping means and as the means for applying false twist. When the false twister is used without rotation, it serves as a twist stopping means; when it is rotated it applies false twist.

In the equipment for manufacturing the multi-component spun yarn of the present invention, it is necessary, as was previously stated, for the yarn delivery tube 14 and the continuous yarn feed tube 3 to be so disposed that their central axes are eccentrically situated and that their openings shall not face each other.

As shown in FIGS. 2, 4, 8, 3A, 3B, 3C and 3D, they are so formed that the eccentricity between the point where the continuous yarn virtually comes out of the continuous yarn feeding tube and the central axis of the yarn delivery tube has a certain value.

When, in particular, a continuous yarn feeding tube is employed with its end bent generally in the shape of the letter "J", as in FIGS. 4 and 8, there is very little interference between the suction air stream A' from the continuous yarn feeding tube 3 and the air stream A from the yarn delivery tube 14, which carries the piecing yarn. This will also be seen from FIGS. 7A, 7B and 7C. Using this configuration it is possible to start spinning very satisfactorily.

When using an apparatus in which the continuous yarn supply tube 3 is positioned facing the yarn delivery tube 14, like the one disclosed in Japanese Patent Application Publication No. 17574/1975 (corresponding to British Pat. No. 1,154,554), it is difficult to obtain a multi-component spun yarn of the present invention in a stabilized operational condition. Furthermore, when the continuous yarn supplying tube 3 and the yarn delivery tube 14 face each other, the air stream A which carries the piecing yarn and the air stream A' which feeds the continuous yarn strike against each other, giving rise to significant operational inconvenience.

When starting by spinning out the 100% spun yarn alone a suction device 33 may be provided immediately downstream of the delivery rollers. This draws in the spun yarn so that it is not wound on the final package. Such a mode is shown in FIG. 7B.

Two continuous yarns may be fed into the rotary spinning chamber, as shown in FIG. 14. This produces a multi-component spun yarn in such a structure that the spun yarn is covered with mixed-twist continuous yarns—two yarns integrated into one—wrapped around the spun core, as shown in FIG. 15A. When the two continuous yarns are fed at sharply different feed rates, this produces a multi-component spun yarn in a fancy tone, like the one shown in FIG. 15B.

Figure 16A:
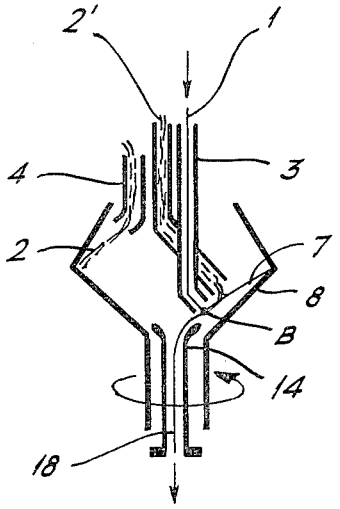
FIGS. 16A and 16B are schematic sectional views of an apparatus in which, as a modification, additional staple fibers other than those which form the spun yarn at the core are fed separately near the point where the continuous yarn is integrated with the spun yarn.
Figure 16B:
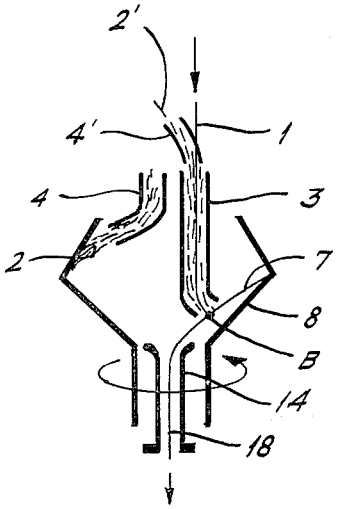
Figure 17:
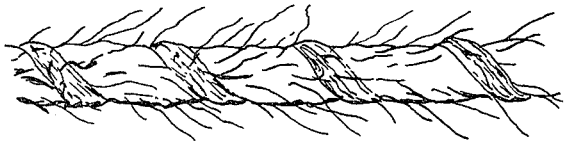
FIG. 17 shows the external appearance of a yarn produced by the method of FIG. 16A or of FIG. 16B.

Referring to FIGS. 16A and 16B, when staple fibers 2' other than staple fibers 2 which form the spun yarn at the core, are fed in the neighborhood of the uniting point B, the resulting multi-component spun yarn is very fluffy. The staple fibers 2' are also integrated into the yarn, as shown in FIG. 17.

The multi-component spun yarn of the present invention is highly useful for the manufacture of a wide range of products for outer garments for all seasons.

Various materials may be used in the staple and in the continuous component. The staple may itself be a mixture or blend of different staple fibers. These include natural fibers and such synthetic fibers as acryl, polyester, rayon, acetate, nylon, etc., as well as blends of these synthetic and natural fibers. These and mixtures and variations thereof may be used as components of the multi-component spun yarn of the present invention.

It is also possible to obtain multicolored fabrics, etc., as desired, by using proper combinations of fibers which are of the same quality but have different dye affinities.

Different kinds of fibers may be used as materials for the spun yarn and/or the continuous yarn.

As the multi-component spun yarn of the present invention consists of a spun yarn with a twist factor of under 3.0 and one or more continuous yarns wrapped around its surface in the form of a spiral, it possesses features which cannot be expected of conventional spun yarns consisting of 100% staple fibers, including the following:

(a) It excels in pill resistance, and has great strength.
(b) It has a good external appearance; when made into textiles it gives a very good surface quality to the fabric.
(c) It possesses a soft touch.

The following Examples are illustrative of the invention. They are not intended to limit the scope of the invention, which is defined in the appended claims.

EXAMPLE 1

With spinning apparatus of the type shown in FIGS. 2, a multi-component spun yarn was manufactured by using 1.5-denier, 44-mm acrylic fibers as the staple fibers 2 and 70-denier, 24-filament polyamide multifilament yarn as the continuous yarn 1.

The spinning conditions were as follows:

| | |
|---|---|
| Rotational speed of the rotary spinning chamber | 32000 rpm |
| I.D. of the outlet end of the continuous yarn feeding tube | 3.4 mm |
| Outside and inside diameters of the frictional means (center piece) 9 provided at the upstream end of the yarn delivery tube 14 | 14 mm (O.D.) 2.5 mm (I.D.) |
| Pressure of compressed air from the piecing yarn feeding nozzle 15 | 0.1 kg/cm$^2$ |
| Yarn count of the spun yarn 7 | 30 s (English cotton yarn count) |
| Twist factor of the spun yarn 7 | K = 2.8 |
| Yarn feed tension of continuous filament yarn 1 | 6 grams |
| Horizontal distance between central axis of yarn delivery tube 14 and center of outlet of continuous yarn feed tube | 12 mm |

Insertion of the piecing yarn at the start and introduction of the filament yarn were both smoothly carried out. The union of the spun yarn 7 and the filament yarn was immediate and satisfactory. The filament yarn began wrapping around the spun yarn just as the uniting point "B", and yarn breakage occurred only rarely. The condition of covering and the location of the uniting point were the same as those shown in the photograph, FIG. 6. The filament yarn met the spun yarn at the end of the center piece 9, and as soon as it was taken up it wrapped around the spun yarn 7 and contacted the surface of said center piece. Friction to which the yarn was subjected made the twist of the filament yarn spread up around the spun yarn 7.

The multi-component spun yarn which was thus obtained had a good external appearance. When made into knit fabrics, it gave the fabric good utility and a nice touch far in excess of any that might be expected of conventional 100% staple fiber spun yarns. When the composition of the multi-compartment spun yarn was analyzed in terms of the ratio of yarn length difference "Q" (%) of the filament yarn content of the multi-component yarn, a value of 5.7% was obtained.

The ratio of yarn length difference Q was obtained by the following method:

A length of the multi-component spun yarn, $L_1$ (mm) was set on a twist tester; the continuous yarn was untwisted and the multi-component yarn was thus separated into two elements, viz., spun yarn and continuous yarn (the number of mixed twist was made zero). Subsequently the spun yarn element was cut away and the length of the continuous yarn only, $L_2$ (mm) was measured. Q (%) was obtained by the following formula:

$$Q = \frac{L_2 - L_1}{L_1} \times 100\ (\%)$$

Measurements were carried out, in the Examples of the present invention, with L, the length of the sample multi-component yarn, set at 350 mm.

EXAMPLE 2

With a spinning apparatus as shown in FIGS. 8 and 9, a multi-component spun yarn according to the present invention was manufactured by feeding 2-denier, 51-mm polyester staple as the staple fibers and 75-denier, 36-filament polyester continuous filament yarn as the continuous yarn.

The effectiveness of certain relationships was assesed. These relationships included (a) whether the false twister 20 was provided or not (b) the conditions under which the yarn is spun out, and (c) the feeding tension of the filament yarn 1 and its effect upon spinnability and quality of yarn.

The following results were obtained:

| | |
|---|---|
| Spinning conditions:- | |
| Rotational speed of the rotary spinning chamber 8 | 35000 rpm |
| Pressure of compressed air from the piecing yarn feed nozzle 15 | 0.1 kg/cm$^2$ |
| Twist factors of the spun yarn 7 formed of staple fibers (two values) | K = 3.0 and K = 4.4 |
| Yarn count of the spun yarn 7 formed of staple fibers | 20 s (English cotton yarn count) |
| Shapes of the frictional means 21 and 22 | As per FIG. 9 |

In the first place, the relationship of the twist factor K and the twist factor of false twist $K_2$ to the spinnability is shown in Table 1.

TABLE 1

| | K | $K_2$ | K + $K_2$ | No. of Yarn Breakages (yarn/10$^3$ sp. × hr) |
|---|---|---|---|---|
| No. 1 (Comparison) | 3.0 | 0 | 3.0 | 300 |
| No. 2 (Comparison) | 3.0 | 0.2 | 3.2 | 192 |
| No. 3 (Comparison | 3.0 | 0.4 | 3.4 | 91 |
| No. 4 (Invention) | 3.0 | 0.5 | 3.5 | 39 |
| No. 5 (Invention) | 3.0 | 1.0. | 4.0 | 15 |
| No. 6 (Invention) | 3.0 | 3.0. | 6.0 | 25 |
| No. 7 (Comparison) | 3.0 | 3.5 | 6.5 | 79 |
| No. 8 (Comparison) | 4.5 | 1.0 | 5.5 | 19 |

| Causes of Yarn Breakage | Bulkiness of the Yarn (cm$^3$/g) | Bending Rigidity (g/cm$^2$) |
|---|---|---|

TABLE 1-continued

| | | |
|---|---|---|
| Spun yarn slipping out of the continuous yarn | — | — |
| Spun yarn slipping out of the continuous yarn | — | — |
| Spun yarn slipping out of the continuous yarn | — | — |
| — | 9.2 | 0.0062 |
| — | 9.4 | 0.0059 |
| — | 9.2 | — |
| Excessive twist given to to the spun yarn | — | — |
| — | 7.8 | 0.0075 |

NOTE:
Comparison = By other method; for comparison.
Invention = According to the present invention.

If the number of yarn breakages is less than 50 yarns/$10^3$ sp. × hr., it does not, generally, offer a serious obstacle to the operation. From Table 1 above, it is seen that the number of yarn breakages is small when the value of $K+K_2$ is more than 3.5 and less than 6.0 and that, therefore, it is possible to carry out production of the multi-component yarn in a stabilized condition in such cases.

In connection with the relationship between proprties of the yarn and the value of K, it is seen that the value of K is more influential upon bulkiness and bending rigidity of the yarn. It is possible to obtain a multi-component yarn which is bulkier and softer when the value of K is smaller.

Table 2 shows the effect upon the spinnability and the structure of the yarn of the ratio of feed tension of the filament yarn ($T_f$) to the tension ($T_s$) of the spun yarn at the time when only staple is spun out.

TABLE 2

| | $T_f/T_s$ | Q(%) | Yarn Structure Type (I or II)** | No. of Yarn Breakages (yarns/$10^3$ sp. × hr) |
|---|---|---|---|---|
| No. 9 (Comparison)* | 0.05 | 17.5 | I | 70 |
| No. 10 (Invention)* | 0.10 | 15.0 | I | 43 |
| No. 11 (Invention) | 0.50 | 4.2 | I | 12 |
| No. 12 (Invention) | 0.90 | 0.51 | I | 45 |
| No. 13 (Comparison)* | 0.95 | 0.12 | I | 68 |
| No. 14 (Comparison) | 1.00 | −0.20 | II | 110 |

*See note below Table 1.
**Yarn structure types:
I = Structure in which the filament yarn just covers the surface of the spun yarn.
II = Structure in which the spun yarn and the filament yarn are mixed twisted; or in which the two are closely united with fibers of the spun yarn component being raised to the surface of the multi-component yarn.

As is clear from Table 2 above, the degree to which the filament yarn binds the spun yarn becomes lower as the value of $T_f/T_s$ is smaller; and when such value is smaller than 0.1, cases sometimes arise where the filament yarn overlaps the spun yarn in the direction of the length of the spun yarn, falling into a slab-like condition. Also, more probability of yarn breakage is encountered.

When, on the other hand, the value of $T_f/T_s$ is larger than 0.9, the structure is such that the spun yarn and the filament yarn are closely united, with the spun yarn being partly raised to the surface of the multi-component yarns; but, in this form, the spun yarn tends to slip along the filament yarn in the axis direction of the yarn, the multi-component yarn becoming random in structure. Further, the probability of yarn breakage rapidly increases. Therefore, the value of about 0.9 is maximum limit from the viewpoint of yarn breakage, as well.

By way of summary, when the value of $T_f/T_s$ is in the range of about 0.1 to 0.9, there is decreased likelihood of yarn breakage. It is possible, by also setting the value of the ratio of yarn length difference Q in the prescribed range, to manufacture multi-component spun yarns which have highly desirable properties, and to do so in a stabilized operation.

We claim:

1. A multi-component spun yarn comprising an open-end spun yarn consisting of staple fibers having a twist factor K of not more than 3.0, and a predetermined number of twists per unit of length, and a continuous yarn wrapped around said spun yarn in a spiral manner in the same direction of twist as that of the twist of said spun yarn, the number of wraps of said continuous yarn per unit of length around said spun yarn being essentially equal to said predetermined number of twists, said continuous yarn partially covering the surface of said spun yarn.

2. A multi-component spun yarn as claimed in claim 1, in which the percentage of yarn length difference is from 0.5% to 15%, said percentage yarn length difference being $$100 \times \frac{L_2 - L_1}{L_1}$$

where $L_1$ is the original length of a sample of said yarn and $L_2$ is the straight length of the continuous yarn taken from said sample.

3. A multi-component spun yarn as claimed in claim 1, in which the weight ratio of the continuous yarn is from 5% to 60% of the total weight of the multi-component spun yarn.

4. A multi-component spun yarn as claimed in claim 1, in which the continuous yarn is a filament yarn.

5. A multi-component spun yarn as claimed in claim 1, in which a plurality of continuous yarns is present.

6. In a multi-component yarn having the excellent touch or hand of spun yarn and having the strength, resistance to pilling and abrasion resistance of continuous filament yarn, and which multi-component yarn is capable of being continuously produced at high speed on an open-end spinning machine, the combination which comprises:

an open-end-spun core comprising staple fibers twisted together in a predetermined direction with a low twist factor, and a continuous generally spirally arranged group of continuous filaments wrapped around said core in the same direction as the twist of said core staple fibers, said continuous filaments being grouped in a manner to form a coherent band which extends substantially spirally and continuously around the outside of said core, the length of said continuous filaments in any predetermined length of said multi-component yarn being greater than the length of said core, and said core having a maximum twist factor of about 3, where said twist factor is the number of turns of twist per inch of said spun yarn core divided by the square root of the English cotton count of the spun core.

7. The multi-component yarn defined in claim 6 wherein the number of spiral turns of said continuous filaments per unit length of the multi-component yarn is substantially equal to the number of turns of twist of said staple fibers in said length.

8. The multi-component yarn defined in claim 6, wherein another filament yarn is also wrapped around said open-spun core.

9. In a multi-component yarn having the excellent touch or hand of spun yarn and having the strength, resistance to pilling and abrasion resistance of continuous filament yarn, and which multi-component yarn is capable of being continuously produced at high speed on an open-end spinning machine, the combination which comprises:

an open-end-spun core comprising staple fibers twisted together in a predetermined direction with a low twist factor, a continuous generally spirally arranged group of continuous first filaments wrapped around said core in the same direction as the twist of said core staple fibers, said continuous first filaments being grouped in a manner to form a coherent band which extends substantially spirally and continuously around the outside of said core, the length of said continuous first filaments in any predetermined length of said multi-component yarn being greater than the length of said core, and a second filament wrapped around said core under lesser tension than said continuous first filaments, said core having a maximum twist factor of about 3, where said twist factor is the number of turns of twist per inch of said spun yarn core divided by the square root of the English cotton count of the spun core.

10. The multi-component yarn defined in claim 9, wherein said other filament yarn also forms a plurality of loops spaced apart from said open-spun core.

11. The multi-component yarn defined in claim 6, wherein said twist factor of said core is about 1.8 to 3.

12. The multi-component yarn defined in claim 6, wherein said yarn has a Q value of about 0.5 to 15, where Q is the ratio of differences of yarn length.

13. The multi-component yarn defined in claim 6, wherein the weight ratio of the continuous filaments is about 5–60%, based upon the total yarn weight.

* * * * *